US009750986B1

(12) United States Patent
Summerlin, Jr.

(10) Patent No.: US 9,750,986 B1
(45) Date of Patent: Sep. 5, 2017

(54) EZ-RISE BALL

(71) Applicant: Joseph B Summerlin, Jr., Montgomery, AL (US)

(72) Inventor: Joseph B Summerlin, Jr., Montgomery, AL (US)

( * ) Notice: Subject to any disclaimer, the term of this patent is extended or adjusted under 35 U.S.C. 154(b) by 0 days.

(21) Appl. No.: 14/988,848

(22) Filed: Jan. 6, 2016

Related U.S. Application Data

(60) Provisional application No. 62/100,214, filed on Jan. 6, 2015.

(51) Int. Cl.

| | |
|---|---|
| ***A63B 69/00*** | (2006.01) |
| ***A63B 37/14*** | (2006.01) |
| ***A63B 43/00*** | (2006.01) |
| ***A63B 37/00*** | (2006.01) |
| *A63B 102/18* | (2015.01) |

(52) U.S. Cl.
CPC ..... *A63B 43/002* (2013.01); *A63B 37/00* (2013.01); *A63B 69/0002* (2013.01); *A63B 2069/0006* (2013.01); *A63B 2102/182* (2015.10); *A63B 2208/0204* (2013.01)

(58) Field of Classification Search
CPC ..... A63B 43/00; A63B 43/002; A63B 43/02; A63B 43/008; A63B 69/0002; A63B 37/00; A63B 2102/182; A63B 2069/0006; A63B 2208/0204
USPC ..... D21/707, 713, 714
See application file for complete search history.

(56) References Cited

U.S. PATENT DOCUMENTS

| | | | | | |
|---|---|---|---|---|---|
| 4,596,389 | A | * | 6/1986 | Frankowski | A63B 43/008 473/569 |
| 4,660,830 | A | * | 4/1987 | Tomar | A63B 45/00 264/161 |
| 4,772,020 | A | * | 9/1988 | Martin | A63B 37/14 273/DIG. 20 |
| 4,919,422 | A | * | 4/1990 | Ma | A63B 37/14 273/DIG. 20 |
| D340,489 | S | * | 10/1993 | Evangelista | D21/713 |
| D351,203 | S | * | 10/1994 | Handy | D21/707 |
| 5,711,725 | A | * | 1/1998 | Bengtson | A63B 43/008 473/451 |
| D503,758 | S | * | 4/2005 | Crane | D21/707 |
| D544,053 | S | * | 6/2007 | Krysiak | D21/713 |
| D556,275 | S | * | 11/2007 | Crane | D21/707 |

(Continued)

*Primary Examiner* — Steven Wong
(74) *Attorney, Agent, or Firm* — Jonathan C. "Rudy" Hill; Bradley Arant Boult Cummings LLP

(57) ABSTRACT

A softball pitching aid enables one to practice throwing rise balls and drop balls at slower speeds than that required by a standard softball. It comprises a ball with opposing convex surfaces at either end of and disposed about a central axis and a plurality of symmetrical slots protruding into its outer surface and disposed circumferentially along the central axis. The ball is constructed of polyurethane foam or other lightweight material. When thrown correctly, the slots interact with ambient air to cause the ball to rise or drop. The slots and lightweight material allow the ball to rise or drop at lower speeds. The slots further provide guidance for gripping the ball and leverage for increasing its spin rate during flight. The ball further comprises a two-tone coloring scheme that, in conjunction with the symmetrical slots, provides instant visual feedback during flight as to whether it was thrown correctly.

17 Claims, 5 Drawing Sheets

(56) References Cited

U.S. PATENT DOCUMENTS

| | | | | |
|---|---|---|---|---|
| 2008/0064539 | A1* | 3/2008 | Mark | A63B 37/14 473/598 |
| 2012/0244962 | A1* | 9/2012 | Muscarello | A63B 37/00 473/451 |

* cited by examiner

EZ-RISE BALL

BACKGROUND OF THE INVENTION

The stitching of a softball forms ridges that affect the aerodynamics of the ball and its movement during flight. A pitcher may take advantage of this fact by spinning the ball relative to its seams in a manner that causes the ball to curve, rise, or drop, thereby making it more difficult to hit.

In fast pitch softball, a pitcher throws a softball with an underarm delivery, which permits the throwing of unique pitches, including the rise ball and the drop ball. A rise ball is a pitch in which the softball rises between the time when a pitcher releases the ball and the time when it reaches the plate. Conversely, a drop ball is a pitch in which the softball drops between the time when the pitcher releases the ball and the time when it reaches the plate. The movement in these pitches is obtained by spinning the ball relative to a central axis of the ball parallel to its seams—back spin to throw a rise ball and forward spin to throw a drop ball.

The rise ball and the drop ball are among the most effective pitches in fast pitch softball. They are also among the most difficult to throw for a number of reasons. First, a high rate of pitch speed is required to effect the desired ball movement; at minimum, pitch speeds of approximately fifty-five (55) miles per hour are required, and pitch speeds in excess of sixty (60) miles per hour are preferred. Second, precision is required for the positioning of the softball in the pitcher's hand, or the pitcher's grip, as the softball must be released so that it spins along a central axis substantially parallel to its seams. Third, these pitches require a fast spin rate to effect the desired movement, preferably a rate of at least twenty-three (23) revolutions per second. Finally, the softball must be released correctly to effect the desired movement.

These challenges make learning how to throw an effective rise ball or drop ball difficult, if not impossible, for the vast majority of fast pitch softball players. Most younger players (typically fourteen to fifteen years of age and younger) are not able to throw a softball at fast enough speeds to throw a rise ball or a drop ball. Thus, it is difficult, if not impossible, for them to practice the correct technique for doing so with a standard softball. And even if the necessary pitch speed can be achieved with a standard softball, there are many other factors (spin rate, spin direction, release) that can prevent one from throwing these pitches successfully. Thus, one who is attempting to throw a rise ball or a drop ball with a standard softball, but not achieving the desired movement, is left to wonder which of these factors is causing the problem.

The invention disclosed herein eliminates these problems by providing a softball pitching aid that enables its user to throw rise balls and drop balls—and to practice the form required to do so—at slower pitch speeds, in the range of thirty (30) to forty (40) miles per hour. Specifically, the invention comprises a ball with a plurality of symmetrical slots disposed about a central axis. When thrown correctly, the symmetrical slots interact with the air (much like the seams on a softball would, but in more exaggerated fashion) to cause the ball to rise or drop, depending on its spin direction. Further, the ball is constructed of lightweight material, such as polyurethane foam. These features of the invention enable younger players or players with slower pitch speeds to use it to practice throwing rise balls and drop balls at slower speeds with a ball that, if thrown with the correct form, rises or drops.

The invention further assists its user in obtaining a desirable spin rate, achieving a correct spin direction (which translates into seam alignment when throwing an actual softball), and perfecting a correct release. The plurality of symmetrical slots guides the user to place his or her fingers on the ball correctly, thereby promoting the correct spin direction and a proper release. The sides of the symmetrical slots also provide the user with a means to exert extra leverage on the ball during the throw to achieve a desirable spin rate.

The invention further assists its user in providing instant visual feedback as to whether a pitch was thrown correctly through its two-tone color scheme. The contrasting colors allow the user to discern the spin direction of the ball after the ball is released and during its flight. Thus, the ball provides instant visual feedback as to whether it is spinning as intended.

BRIEF SUMMARY OF THE INVENTION

A softball pitching aid according to an embodiment of the present disclosure comprises a spherical ball with an outer surface comprising opposing convex surfaces at either end of and disposed about a central axis, a plurality of ribs, and a plurality of symmetrical slots interspersed evenly among the ribs, protruding inwardly, and disposed circumferentially along the central axis, running from one convex surface to the other. The slots and ribs are interspersed uniformly and evenly, such that there is an equal number of slots and ribs.

Each symmetrical slot is defined by a base, opposing walls, and opposing ends. The slots are internally symmetrical and of the same size and shape and spaced uniformly about the circumference of the ball. In one embodiment, the ball has eight (8) symmetrical slots protruding into its outer surface and disposed circumferentially along the central axis and dispersed uniformly about the central axis.

The base of each symmetrical slot further comprises a pair of adjoining convex bands that run circumferentially along the central axis of the ball—from one end of the slot to the other—and alongside one another. The bands are angled inwardly toward one another, such that their shared boundary creates an indentation along the centerline of the slot.

The sides of the bands opposite their shared boundary adjoin the bases of the opposing walls defining the slot. The opposing walls, in turn, mirror one another and slope outwardly and away from one another in substantially linear fashion, from the base of the slot to the outer surface of the ball.

Each slot is further defined by opposing ends that connect the base of the slot to the convex surfaces. The opposing ends mirror one another and connect the base of the slot to the convex surfaces in substantially linear fashion.

It is an advantage of a softball pitching aid of the present disclosure that the slots render the outer surface of the ball non-uniform and enable it to interact with ambient air, allowing the ball to rise or to drop—when thrown correctly—at much slower speeds than a standard softball. This feature enables one to practice throwing rise balls and drop balls without having to achieve the ball speed required by a standard softball to effect such movement.

It is a further advantage of a softball pitching aid of the present disclosure that the slots are shaped to accept the fingers of one using the ball to enable him or her to practice throwing rise balls and drop balls with a correct grip. This design promotes correct positioning of the hand when throwing the ball to achieve the spin direction necessary to throw rise balls and drop balls.

It is a further advantage of a softball pitching aid of the present disclosure that the opposing walls of the slots provide surfaces upon which a user can exert pressure to effect a higher spin rate of the ball, thereby promoting the spin rate necessary to throw rise balls and drop balls.

It is a further advantage of a softball pitching aid of the present disclosure that the ball provides instant feedback as to whether it was thrown correctly. Specifically, it has a two-tone color scheme in which one half of the ball is one color and the other half is a different color, the halves being defined by a plane perpendicular to the central axis about which the slots are disposed and intersecting the center of the ball. The two-tone color scheme allows a user to observe the spin of the ball during its flight.

It is a further advantage of a softball pitching aid of the present disclosure that the slots are symmetrical. This symmetry promotes the best pitch being one that spins about the central axis. This, in turn, corresponds with the plane separating the contrasting colors of the ball remaining vertical during flight, providing visual feedback as to whether the ball was thrown correctly.

In one embodiment of a softball pitching aid of the present disclosure, the ball is constructed of polyurethane foam. Other lightweight materials may be used for the ball, including rubber. These lightweight materials further promote the ability of the ball to rise or drop at lower speeds as compared to that of a standard softball.

The combined advantages disclosed herein enable the softball pitching aid to serve as a training tool. It teaches a user to recognize and achieve the correct grip, spin speed, and spin direction necessary for throwing a rise ball or a drop ball.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

These and other embodiments of the present invention will also become readily apparent to those skilled in the art from the following detailed description of an exemplary embodiment having reference to the attached figures, the invention not being limited to any particular embodiment(s) disclosed.

Figure 1:
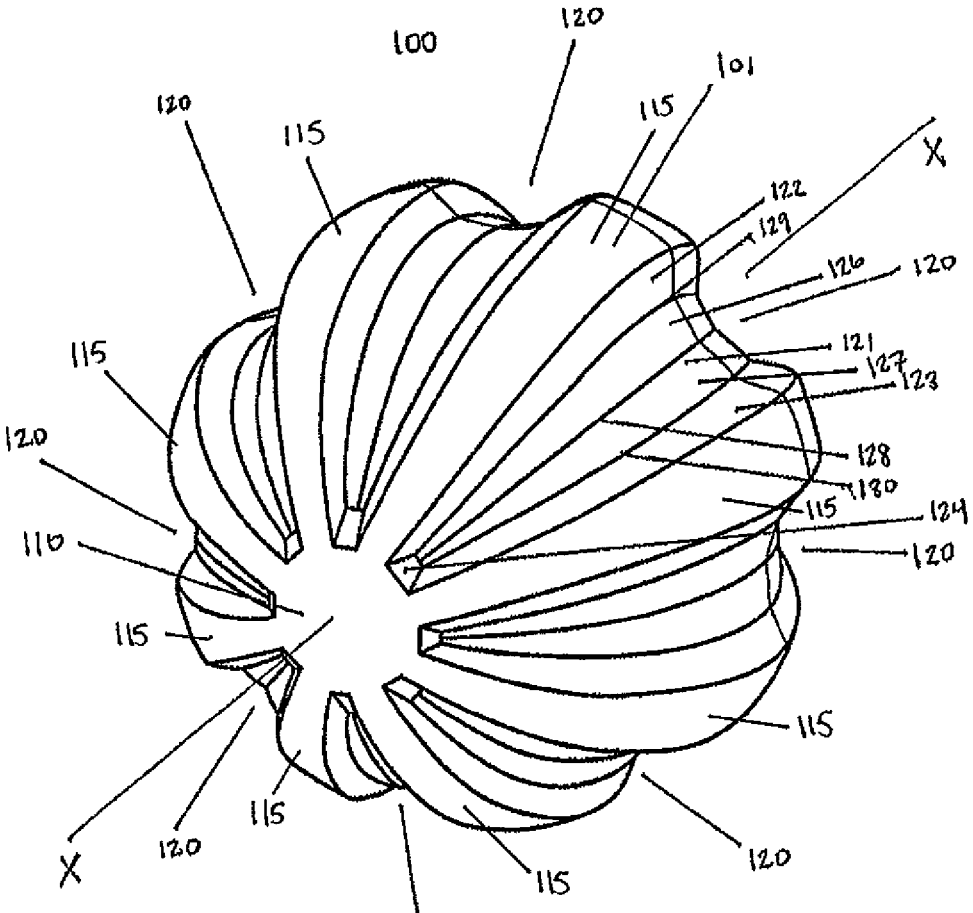
FIG. 1 is a perspective view of a softball pitching aid of the present disclosure.

Repeat use of reference characters throughout the present specification and appended drawings is intended to represent the same or analogous features or elements of the invention.

DETAILED DESCRIPTION OF THE INVENTION

The invention described herein is a softball pitching aid to be used to practice throwing rise balls and drop balls in fast pitch softball. The apparatus is a lightweight ball comprising a plurality of symmetrical slots that, when the ball is thrown, mimic the interaction between the seams of a softball and the ambient air in exaggerated fashion, enabling one to throw rise balls and drop balls at slower speeds and to practice their delivery for doing so with instant visual feedback. The slots further guide the user to position his or her hand correctly on the ball and also provide a means for the user to exert additional pressure on the ball to increase spin speed.

Figure 2:
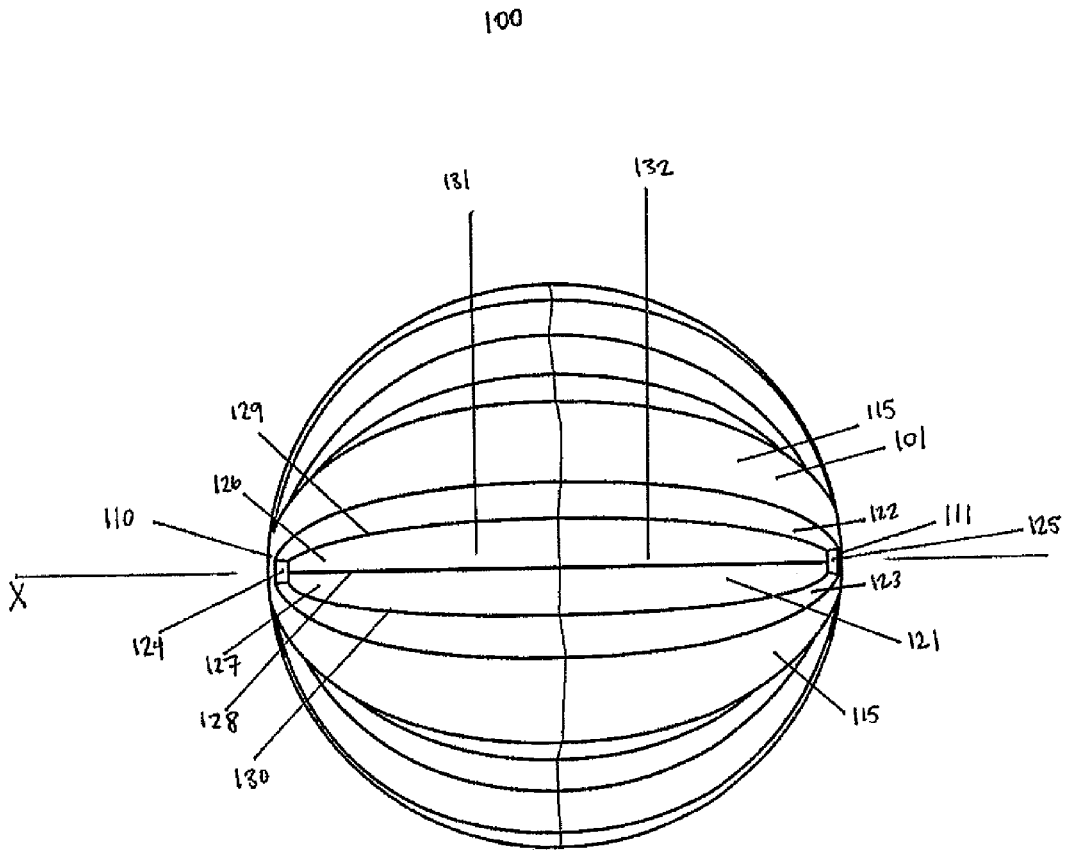
FIG. 2 is a front view of the apparatus of FIG. 1, it being understood that the top, rear, and bottom views would be identical.
Figure 3:
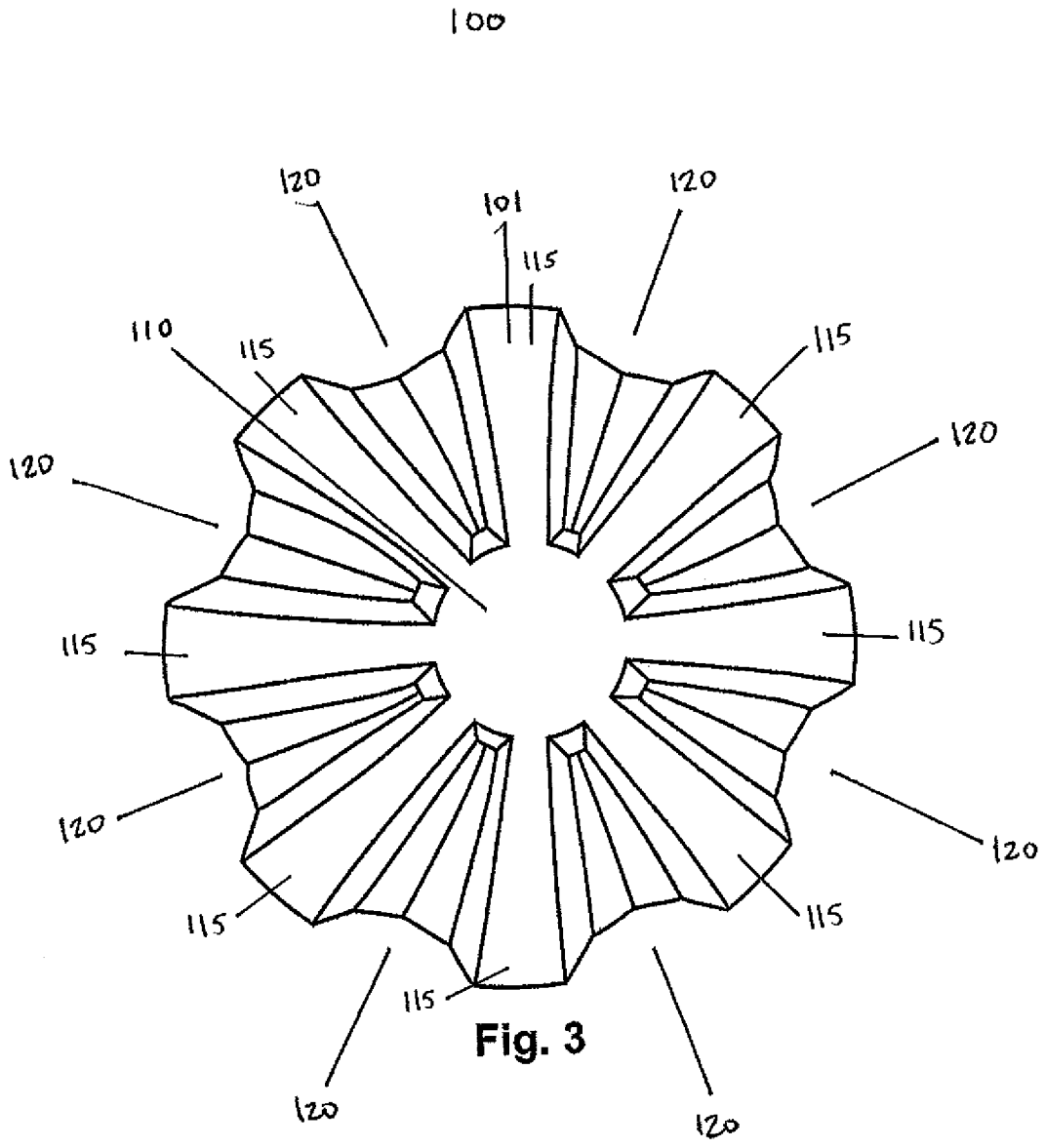
FIG. 3 is a left side view of the apparatus of FIG. 1, it being understood that a right side view would be identical, except of a different color.

Referring to FIGS. 1-3, a softball pitching aid comprises a ball 100 with an outer surface 101 comprising opposing convex surfaces 110, 111 at either end of and disposed about a central axis X, a plurality of ribs 115, and a plurality of symmetrical slots 120 protruding inwardly and disposed circumferentially along the central axis X. In a preferred embodiment, the ball 100 has a total of eight (8) slots 120.

Each slot 120 comprises a base 121, opposing walls 122, 123, and opposing ends 124, 125. The slots 120 are of the same size and shape and spaced uniformly about the circumference of the ball 100. The base 121 of each slot 120 further comprises a pair of adjoining convex bands 126, 127 that run circumferentially along the central axis X of the ball 100—from one end of the slot 120 to the other—and alongside one another. The bands 126, 127 are angled inwardly toward one another, such that their shared boundary 128 creates an indentation along the centerline of the slot 120.

The sides 129, 130 of the bands 126, 127 opposite their shared boundary 128 adjoin the bases of the opposing walls 122, 123 defining the slot. The opposing walls 122, 123, in turn, mirror one another and slope outwardly and away from one another in substantially linear fashion, from the base 121 of the slot 120 to the outer surface 101 of the ball 100.

Each slot 120 is further defined by opposing ends 124, 125 that connect the base 121 of the slot 120 to the convex surfaces 110, 111. The opposing ends 124, 125 mirror one another and connect the base 121 of the slot 120 to the convex surfaces 110, 111.

Referring specifically to FIG. 2, it can be seen that the left half 131 and right half 132 of each slot 120 are mirror images of one another, such that each slot is bilaterally symmetric in reference to a plane passing through the center of the ball 100 and perpendicular to its central axis X. Referring specifically to FIG. 3, it can be seen that the top and bottom halves of each slot 120 are mirror images of one another, such that each slot 120 is bilaterally symmetric in reference to a plane passing through the center line of the slot 120 and the center of the ball 100. Thus, when the slots 120 are evenly dispersed about the outer surface 101 of the ball 100, the ball 100 is radially symmetric along its central axis X. This bilateral and radial symmetry enables the ball 100 to be equally suited for throwing both rise balls and drop balls. It also facilitates the visual aid function of the ball, as it renders the most effective pitch one that spins about the central axis X during flight, which corresponds with the plane separating the two colors remaining vertical during flight. Thus, whether a pitch is thrown correctly is easily discernible from the visual coloring of the ball during its flight.

Figure 4:
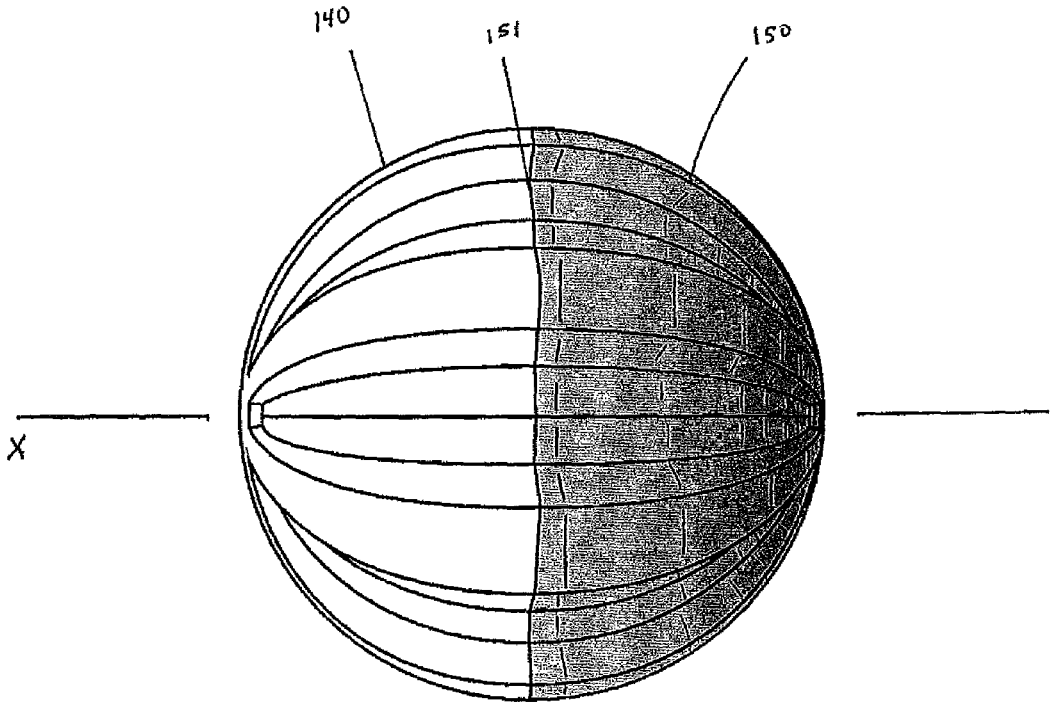
FIG. 4 is a front view of the apparatus of FIG. 1 depicting the use of a two-tone color scheme to enhance its effectiveness.

FIG. 4 depicts an exemplary embodiment of a softball pitching aid of the present disclosure with a two-tone coloring scheme to facilitate instant visual feedback during flight. The left half 140 of the ball 100 is one color and the right half 150 is a contrasting color, a dividing line 151 being defined by a plane intersecting the center of the ball 100 and situated perpendicularly to the central axis X of the ball 100. This coloring provides instant feedback as to the spin of the ball during its flight.

Figure 5:
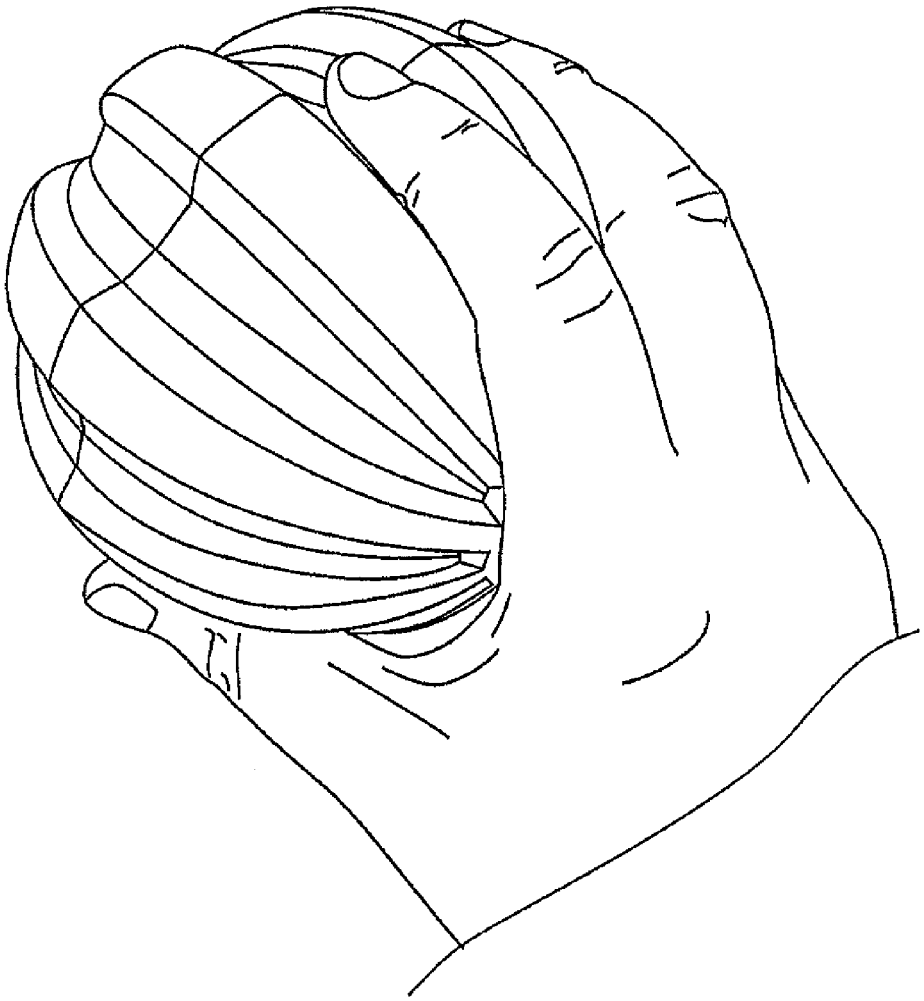
FIG. 5 is a perspective view of the apparatus of FIG. 1 depicting a user's hand positioned about it.

Finally, FIG. 5 depicts an exemplary embodiment of a softball pitching aid of the present disclosure with a user's hand positioned on the apparatus in preparation to throw it.

I claim:

1. A softball pitching aid comprising:

a spherical ball with an outer surface, a center, and a central axis, the outer surface comprising opposing convex surfaces at either end of and disposed about the central axis, a plurality of ribs, and a plurality of slots protruding into the spherical ball, spanning circumferentially from one convex surface to the other, and dispersed evenly about the central axis, each slot having a centerline spanning from one convex surface to the other, each slot further comprising a base, opposing walls, and opposing ends, the base comprising a pair of convex bands having a shared boundary at the centerline of the slot and tilted inwardly toward one another to form an indentation along the centerline of the slot, wherein each slot is bilaterally symmetric in reference to a first plane passing through the center of the spherical ball and perpendicular to its central axis and each slot is also bilaterally symmetric in reference to a second plane passing through the center of the spherical ball and the centerline of the slot, such that the spherical ball is radially symmetric along its central axis.

2. The softball pitching aid as claimed in claim 1, wherein the opposing walls of each slot mirror one another and slope outwardly and away from one another in substantially linear fashion from the base of the slot to the adjacent ribs.

3. The softball pitching aid as claimed in claim 1, wherein the opposing ends of each slot mirror one another and connect the base of the slot to the opposing convex surfaces in substantially linear fashion.

4. The softball pitching aid as claimed in claim 1, wherein the spherical ball has eight slots.

5. The softball pitching aid as claimed in claim 1, wherein a first half of the outer surface of the spherical ball is a first color and a second half of the outer surface of the spherical ball is a second color, the halves being defined by the first plane.

6. The softball pitching aid as claimed in claim 1, wherein the spherical ball is constructed of polyurethane foam.

7. A softball pitching aid comprising:

a spherical ball with an outer surface, a center, and a central axis, the outer surface comprising a plurality of congruent slots spanning circumferentially along the central axis and dispersed evenly about the central axis, each slot having a centerline, each slot further comprising a base, opposing walls, and opposing ends, the base comprising a pair of convex bands having a shared boundary at the centerline of the slot and tilted inwardly toward one another to form an indentation along the centerline of the slot, wherein each slot is bilaterally symmetric in reference to a first plane passing through the center of the spherical ball and perpendicular to its central axis and each slot is also bilaterally symmetric in reference to a second plane passing through the center of the spherical ball and the centerline of the slot, such that the spherical ball is radially symmetric along its central axis.

8. The softball pitching aid as claimed in claim 7, wherein the outer surface further comprises opposing convex surfaces at either end of and disposed about the central axis.

9. The softball pitching aid as claimed in claim 7, wherein the outer surface further comprises a plurality of ribs dispersed among and in between the slots.

10. The softball pitching aid as claimed in claim 7, wherein the spherical ball has eight slots.

11. The softball pitching aid as claimed in claim 7, wherein a first half of the outer surface of the spherical ball is a first color and a second half of the outer surface of the spherical ball is a second color, the halves being defined by the first plane.

12. The softball pitching aid as claimed in claim 7, wherein the spherical ball is constructed of polyurethane foam.

13. A softball pitching aid comprising:

a spherical ball with an outer surface, a center, and a central axis, the outer surface comprising opposing convex surfaces at either end of and disposed about the central axis, a plurality of ribs, and a plurality of slots protruding into the spherical ball, spanning circumferentially from one convex surface to the other, and dispersed evenly about the central axis, each slot having a centerline spanning from one convex surface to the other, each slot further comprising a base, opposing walls, and opposing ends, the base comprising a pair of convex bands having a shared boundary at the centerline of the slot, wherein each slot is bilaterally symmetric in reference to a first plane passing through the center of the spherical ball and perpendicular to its central axis and each slot is also bilaterally symmetric in reference to a second plane passing through the center of the spherical ball and the centerline of the slot, such that the spherical ball is radially symmetric along its central axis.

14. The softball pitching aid as claimed in claim 13, wherein the convex bands comprising the base of each slot are tilted inwardly toward one another to form an indentation along the centerline of the slot.

15. The softball pitching aid as claimed in claim 13, wherein the opposing walls of each slot mirror one another and slope outwardly and away from one another in substantially linear fashion from the base of the slot to the adjacent ribs.

16. The softball pitching aid as claimed in claim 13, wherein the opposing ends of each slot mirror one another and connect the base of the slot to the opposing convex surfaces in substantially linear fashion.

17. The softball pitching aid as claimed in claim 13, wherein a first half of the outer surface of the spherical ball is a first color and a second half of the outer surface of the spherical ball is a second color, the halves being defined by the first plane.

* * * * *